US009206816B2

(12) United States Patent
Olmo et al.

(10) Patent No.: US 9,206,816 B2
(45) Date of Patent: Dec. 8, 2015

(54) AXIAL FAN

(71) Applicant: JOHNSON ELECTRIC S.A., Murten (CH)

(72) Inventors: Fabio Olmo, Asti (IT); Gabriele Milanese, Asti (IT)

(73) Assignee: Johnson Electric S.A., Murten (CH)

( * ) Notice: Subject to any disclaimer, the term of this patent is extended or adjusted under 35 U.S.C. 154(b) by 463 days.

(21) Appl. No.: 13/673,721

(22) Filed: Nov. 9, 2012

(65) Prior Publication Data

US 2013/0115087 A1 May 9, 2013

(30) Foreign Application Priority Data

Nov. 9, 2011 (IT) ..... TO2011A1033

(51) Int. Cl.
*F04D 29/32* (2006.01)

(52) U.S. Cl.
CPC ..... *F04D 29/326* (2013.01)

(58) Field of Classification Search
CPC ... F04D 29/325; F04D 29/326; F04D 29/181; F04D 29/164; F04D 29/34
USPC ..... 416/189
See application file for complete search history.

(56) References Cited

U.S. PATENT DOCUMENTS 855,131 A * 5/1907 Preidel ..... 415/221
7,083,387 B2 * 8/2006 Chen et al. ..... 416/195
7,632,063 B2 * 12/2009 Takeuchi et al. ..... 415/119

* cited by examiner

*Primary Examiner* — Troy Chambers
*Assistant Examiner* — Joshua Semick
(74) *Attorney, Agent, or Firm* — Muncy, Geissler, Olds & Lowe, P.C.

(57) ABSTRACT

An axial fan has a hub whose axis coincides with the rotational axis of the fan, a plurality of vanes that extend from the hub, and an outer ring which is coaxial with the hub. The ring has a front portion and a rear portion. The outer ring defines within itself a passage towards the rear portion. The radially outermost ends of the vanes are connected to the inner surface of the passage. The rear portion of the ring has a plurality of appendages that extend axially away from the front portion of the ring, and which alternate circumferentially with corresponding intermediate recesses. Each vane has its radially outermost end connected to an inner surface of one of the appendages.

5 Claims, 3 Drawing Sheets

AXIAL FAN

CROSS REFERENCE TO RELATED APPLICATIONS

This non-provisional patent application claims priority under 35 U.S.C. §119(a) from Patent Application No. TO 2011A001033 filed in Italy on Nov. 9, 2011.

FIELD OF THE INVENTION

This invention relates to an axial fan and in particular, to an axial fan for a ventilator for cooling a heat exchanger, such as a radiator of a motor vehicle.

BACKGROUND OF THE INVENTION

FIG. 1 of the attached drawings is a partial illustration of an axial fan 1 according to the prior art, of the type defined above. This fan 1 comprises a hub 2 whose axis is indicated by A-A. A plurality of vanes 3 (only one of which is shown in FIG. 1) extends from the hub 2, the radially outermost ends of the vanes being connected to the inner surface of an outer ring 4. In the embodiment of FIG. 1, the ring 4 has a flared front portion 4*a*, defining a passage whose cross section tapers towards the rear portion 4*b*, to which the radially outermost ends of the vanes 3 are connected. The front and the rear are defined in the air flow direction, such that the front corresponds to the intake side of the fan and the rear corresponds to the exhaust side.

In the fan according to the prior art shown in FIG. 1, the rear portion 4*b* of the outer ring 4 is essentially cylindrical.

A fan of this type is typically made from one piece of plastic material, by injection molding.

SUMMARY OF THE INVENTION

One object of the present invention is to provide an axial fan which has a significant reduction in the material required for its production and an appreciable improvement in its operating efficiency.

This is achieved in the present invention by modifying the shape of the outer ring.

Accordingly, in one aspect thereof, the present invention provides an axial fan, comprising: a hub whose axis coincides with the rotation axis of the fan; a plurality of vanes which extend from the hub; and an outer ring which is coaxial with the hub, and which includes a front portion and a rear portion, the outer ring defining within itself a passage from the front portion to the rear portion, wherein the rear portion of the ring comprises a plurality of appendages which extend axially in a direction away from the front portion of the ring, and which alternate circumferentially with corresponding intermediate recesses, and a radially outermost end of each vane is connected to an inner surface of a respective one of said appendages.

Preferably, the fan is intended in use to be driven in rotation in a predetermined direction, and each appendage has a lateral leading edge which with respect to the direction of rotation is inclined rearwardly away from the front portion of the ring.

Preferably, each appendage and the adjacent recesses define there between transitions with sinuous edges.

Preferably, the transitions have a circumferential profile which is essentially S-shaped.

Preferably, the radially outermost ends of each vane is connected to the inner surface of the passage and the inner surface of the corresponding appendage.

BRIEF DESCRIPTION OF THE DRAWINGS

A preferred embodiment of the invention will now be described, by way of example only, with reference to figures of the accompanying drawings. Dimensions of components and features shown in the figures are generally chosen for convenience and clarity of presentation and are not necessarily shown to scale. The figures are listed below.

In FIGS. 2 and 3, parts and elements described previously with respect to FIG. 1 have been given the same reference numerals as those used previously.

DETAILED DESCRIPTION OF THE PREFERRED EMBODIMENTS

Figure 2:
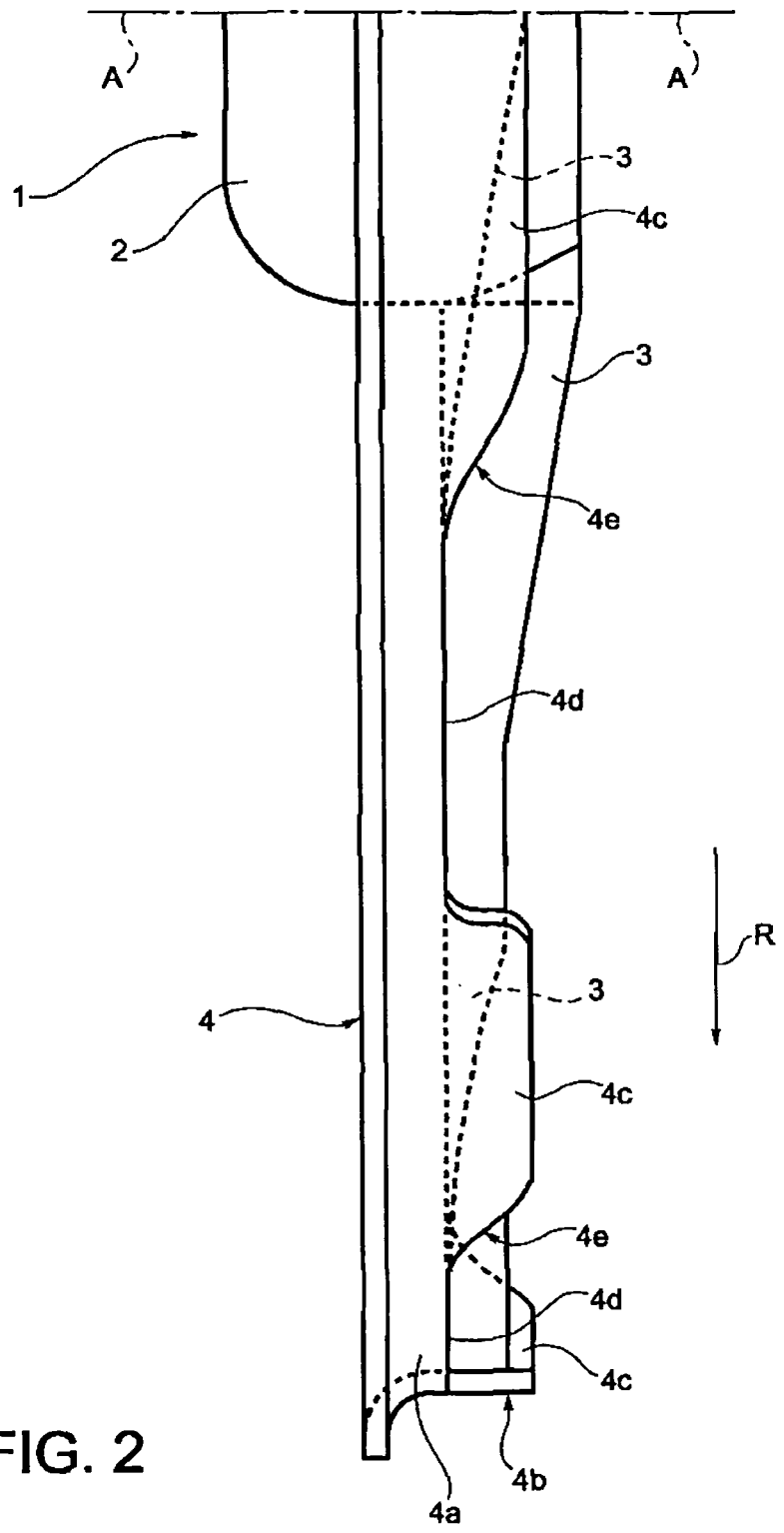
FIG. 2 is a view similar to that of FIG. 1, and is a partial illustration of an axial fan according to the present invention.

As shown in FIG. 2 in particular, in an axial fan 1 according to the present invention the outer ring 4 again has a front portion 4*a* which defines within itself a passage towards the rear portion 4*b*. This front portion 4*a* is, for example, but not necessarily, flared so as to define within itself a passage whose cross section tapers progressively towards the rear portion 4*b* of the ring 4.

In the fan 1 according to the invention, the rear portion 4*b* of the ring 4 comprises a plurality of appendages 4*c* which extend axially away from the front portion 4*a* of the ring. The appendages 4*c* alternate circumferentially with corresponding intermediate recesses 4*d* (see also FIG. 3).

The radially outermost end of each the vanes 3 of the fan is connected to the inner surface of a corresponding appendage 4*c*. The connection of the vane to the appendage is along the axial midsection of the appendage as shown in FIG. 2. Thus, the connection is above the bottom edge of the appendage at the lower portion and roughly at the top edge of the appendage at the top portion.

Figure 3:
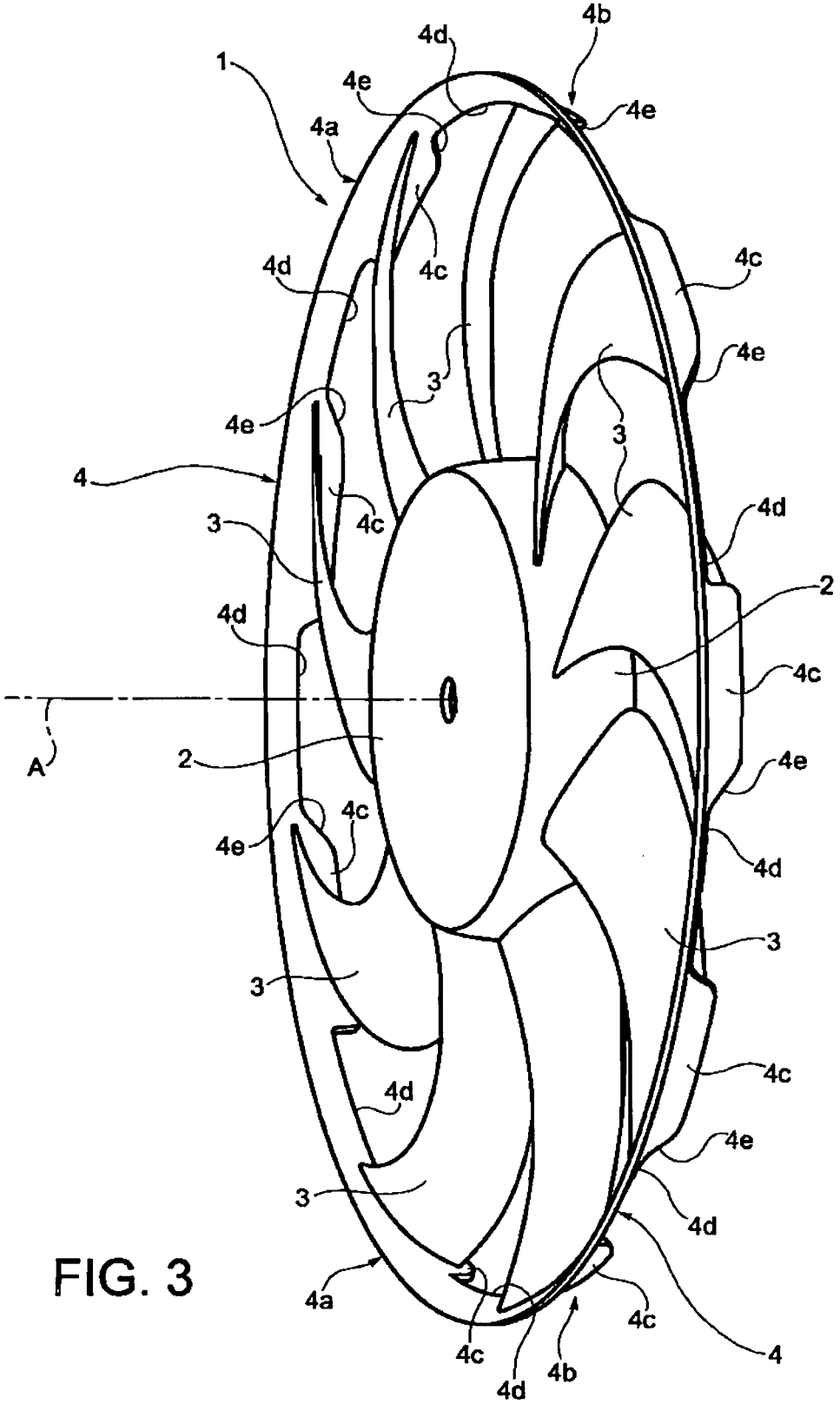
FIG. 3 is an overall perspective view of the axial fan of FIG. 2.

The fan 1 shown in FIGS. 2 and 3 is intended, in use, to be driven in rotation in a predetermined direction, indicated by the arrow R. In a corresponding way, each of the appendages 4*c* has a lateral leading edge 4*e* which, with respect to said direction of rotation, is essentially inclined rearwardly away from the front portion 4*a* of the ring 4. This considerably limits the disturbance of the air flow during operation of the fan.

Conveniently, each appendage 4*c* and the adjacent recesses 4*d* define there between transitions with sinuous edges, with a circumferential profile which is essentially S-shaped, as can be seen in FIG. 2 in particular. These sinuous edges are on both edges of each appendage and are separated by a central section that has a flat circumferential profile. This means that every point on the central section has the same distance from the front portion of the ring.

Figure 1:
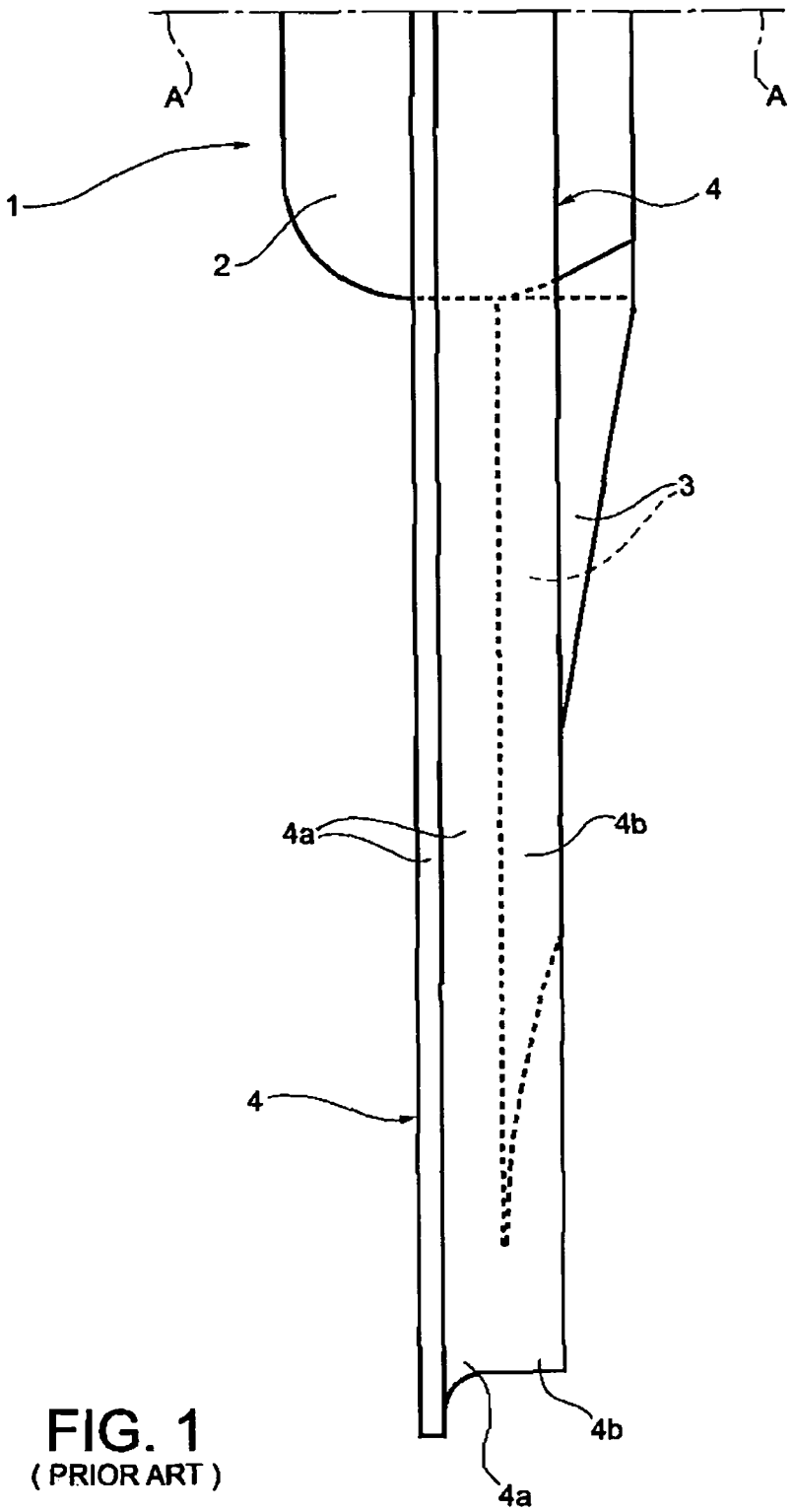
FIG. 1 ( PRIOR ART )
FIG. 1, described above, is a partial illustration of an axial fan according to the prior art.

By comparison with a fan according to the prior art, such as that shown in FIG. 1, an axial fan according to the invention of the type shown in FIG. 2 is characterized by an appreciable reduction in the material required for its production. Tests conducted by the applicant have demonstrated a weight reduction of about 6%, accompanied by an improvement of about 2% in the operating efficiency of the fan.

An appreciable improvement in the reduction of the tonal noise generated by the fan was also found.

In the description and claims of the present application, each of the verbs "comprise", "include", "contain" and "have", and variations thereof, are used in an inclusive sense, to specify the presence of the stated item but not to exclude the presence of additional items.

Although the invention is described with reference to one preferred embodiment, given purely as a non-limiting example, it should be appreciated by those skilled in the art that various modifications are possible. Therefore, the scope of the invention is to be determined by reference to the claims that follow.

The invention claimed is:

1. Axial fan, comprising:

a hub whose axis coincides with the rotation axis of the fan;

a plurality of vanes which extend from the hub; and an outer ring which is coaxial with the hub, and which includes a front portion and a rear portion, the outer ring defining within itself a passage from the front portion to the rear portion, wherein the rear portion of the ring comprises a plurality of appendages which extend axially in a direction away from the front portion of the ring, and which alternate circumferentially with corresponding intermediate recesses, and a radially outermost end of each vane is connected to an inner surface of a respective one of said appendages and an inner surface of the passage;

wherein each appendage has transitions with sinuous edges on both edges separated by a central section having a constant distance from the front portion of the outer ring; and wherein a rearmost portion of the connection of each vane to the corresponding inner surface of the appendage is located axially closer to the front portion of the outer ring than a rear edge of the appendage.

2. The fan of claim 1, intended in use to be driven in rotation in a predetermined direction, and wherein each of said appendages has a lateral leading edge which with respect to said direction of rotation is inclined rearwardly away from the front portion of the ring.

3. The fan of claim 1, wherein each appendage and the adjacent recesses define there between said transitions with sinuous edges, with a circumferential profile which is essentially S-shaped.

4. The fan of claim 2, wherein each appendage and the adjacent recesses define there between said transitions with sinuous edges.

5. The fan of claim 4, wherein each of the transitions has a circumferential profile which is S-shaped.

* * * * *